US008344844B2

(12) United States Patent
Darr

(10) Patent No.: US 8,344,844 B2
(45) **Date of Patent: *Jan. 1, 2013**

(54) FUSE STATE INDICATOR SYSTEMS

(75) Inventor: Matthew R. Darr, Godfrey, IL (US)

(73) Assignee: Cooper Technologies Company, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/943,151

(22) Filed: Nov. 10, 2010

(65) Prior Publication Data

US 2011/0057760 A1 Mar. 10, 2011

Related U.S. Application Data

(60) Division of application No. 11/877,949, filed on Oct. 24, 2007, now Pat. No. 7,855,630, which is a continuation-in-part of application No. 11/674,880, filed on Feb. 14, 2007, now Pat. No. 7,576,630, which is a continuation-in-part of application No. 11/603,454, filed on Nov. 22, 2006, now Pat. No. 7,561,017, which is a continuation-in-part of application No. 11/274,003, filed on Nov. 15, 2005, now Pat. No. 7,474,194, which is a continuation-in-part of application No. 11/222,628, filed on Sep. 9, 2005, now Pat. No. 7,495,540.

(60) Provisional application No. 60/609,431, filed on Sep. 13, 2004.

(51) Int. Cl.

| | |
|---|---|
| ***H01H 37/08*** | (2006.01) |
| ***H01H 9/10*** | (2006.01) |
| ***H01H 21/16*** | (2006.01) |

(52) U.S. Cl. ..... 337/206; 337/8; 337/59; 337/61; 337/62; 337/70; 337/72; 337/79; 337/143; 361/837

(58) Field of Classification Search ..... 337/79, 337/143, 206, 72, 8, 59, 62, 70, 61; 361/837
See application file for complete search history.

(56) References Cited

U.S. PATENT DOCUMENTS 2,726,378 A * 12/1955 Norcross ..... 340/638
4,498,077 A * 2/1985 Richardson ..... 340/648

(Continued)

FOREIGN PATENT DOCUMENTS

WO 9613847 5/1996

(Continued)

OTHER PUBLICATIONS

International Search Report and Written Opinion of PCT/US2008/079130; Dec. 22, 2008; 12 pages.

*Primary Examiner* — Anatoly Vortman
(74) *Attorney, Agent, or Firm* — Armstrong Teasdale LLP

(57) ABSTRACT

Fuse state indicators for use with disconnect devices having a fuse are provided. Fuse state indicators include a housing having circuitry, a detecting means for detecting an open circuit condition, conductors adapted for electrical connection to a disconnect device so as to complete a circuit connecting the detecting means with a fuse of the disconnect device, and a signal transmitting means The detecting means is configured to transmit a signal to the signal transmitting means for determining an operational state of the fuse. The signal transmitting means, in turn, is configured to transmit a signal to a remote device the state of the fuse.

32 Claims, 4 Drawing Sheets

U.S. PATENT DOCUMENTS

| | | | | |
|---|---|---|---|---|
| 4,556,874 | A | 12/1985 | Becker | |
| H248 | H * | 4/1987 | Middlebrooks | 340/639 |
| 4,691,197 | A | 9/1987 | Damiano et al. | |
| 5,561,580 | A | 10/1996 | Pounds et al. | |
| 7,167,351 | B2 * | 1/2007 | Raymond et al. | 361/93.1 |
| 7,369,029 | B2 | 5/2008 | Ackermann | |
| 7,400,493 | B2 * | 7/2008 | Ewing et al. | 361/623 |
| 7,576,635 | B2 | 8/2009 | Bender et al. | |
| 7,612,654 | B2 | 11/2009 | Bender et al. | |
| 2005/0231320 | A1 * | 10/2005 | Ackermann | 337/206 |
| 2006/0077607 | A1 | 4/2006 | Henricks et al. | |

FOREIGN PATENT DOCUMENTS

| | | | |
|---|---|---|---|
| WO | 2005104161 | A1 | 11/2005 |
| WO | 2008101111 | A2 | 8/2008 |
| WO | 2008101111 | A3 | 8/2008 |

* cited by examiner

FUSE STATE INDICATOR SYSTEMS

CROSS REFERENCE TO RELATED APPLICATIONS

This application is a divisional application of U.S. patent Ser. No. 11/877,949 filed Oct. 24, 2007 now U.S. Pat. No. 7,855,630 and entitled "Fuse State Indicator Systems, which is a continuation-in-part application of U.S. application Ser. No. 11/674,880 filed Feb. 14, 2007 (now issued U.S. Pat. No. 7,576,630) and entitled "Fusible Switching Disconnect Modules and Devices," which is a continuation-in-part application of U.S. application Ser. No. 11/603,454 filed Nov. 22, 2006 (now issued U.S. Pat. No. 7,561,017) and entitled "Fusible Switching Disconnect Modules and Devices," which is a continuation-in-part application of U.S. application Ser. No. 11/274,003 filed Nov. 15, 2005 (now issued U.S. Pat. No. 7,474,194) and entitled "Fusible Switching Disconnect Modules and Devices," which is a continuation-in-part application of U.S. application Ser. No. 11/222,628 filed Sep. 9, 2005 (now issued U.S. Pat. No. 7,495,540) and entitled "Fusible Switching Disconnect Modules and Devices," which claims the benefit of U.S. Provisional Application Ser. No. 60/609,431 filed Sep. 13, 2004, the disclosures of which are hereby incorporated herein by reference in their entirety.

BACKGROUND OF THE INVENTION

The present application relates generally to fuse accessories. More particularly, the present application relates to fuse state indicator modules for fusible disconnect devices.

Fuses are widely used as overcurrent protection devices to prevent costly damage to electrical circuits. Fuse terminals typically form an electrical connection between an electrical power source and an electrical component or a combination of components arranged in an electrical circuit. One or more fusible links or elements, or a fuse element assembly, is connected between the fuse terminals, so that when electrical current through the fuse exceeds a predetermined limit, the fusible elements melt, or otherwise fail, and opens one or more circuits through the fuse to prevent electrical component damage.

In some applications, fuses are employed not only to provide fused electrical connections but also for connection and disconnection, or switching, purposes to complete or break an electrical connection or connections. As such, an electrical circuit is completed or broken through conductive portions of the fuse, thereby energizing or de-energizing the associated circuitry. Typically, the fuse is housed in a fuse holder having terminals that are electrically coupled to desired circuitry. When conductive portions of the fuse, such as fuse blades, terminals, or ferrules, are engaged to the fuse holder terminals, an electrical circuit is completed through the fuse, and when conductive portions of the fuse are disengaged from the fuse holder terminals, the electrical circuit through the fuse is broken. Therefore, by coupling and decoupling the fuse to and from the fuse holder terminals, a fused disconnect switch is realized.

Known fused disconnects are subject to a number of problems in use. For example, any attempt to remove the fuse while the fuses are energized and under load may result in hazardous conditions because dangerous arcing may occur between the fuses and the fuse holder terminals. Some fuseholders designed to accommodate, for example. UL (Underwriters Laboratories) Class CC fuses and IEC (International Electrotechnical Commission) 10×38 fuses that are commonly used in industrial control devices include permanently mounted auxiliary contacts and associated rotary cams and switches to provide early-break and late-make voltage and current connections through the fuses when the fuses are pulled from fuse clips in a protective housing. In some instances, the protective housing may have a drawer for receiving the fuses, and one or more of the fuses may be pulled from the fuse clips, for example, by removing the drawer from the protective housing. Early-break and late-make connections are commonly employed, for example, in motor control applications. While early-break and late-make connections may increase the safety of such devices to users when installing and removing fuses, such features increase costs, complicate assembly of the fuseholder, and are undesirable for switching purposes.

Structurally, the early-break and late-make connections can be intricate and may not withstand repeated use for switching purposes. In addition, when opening and closing the drawer to disconnect or reconnect circuitry, the drawer may be inadvertently left in a partly opened or partly closed position. In either case, the fuses in the drawer may not be completely engaged to the fuse terminals, thereby compromising the electrical connection and rendering the fuseholder susceptible to unintended opening and closing of the circuit. Especially in environments subject to vibration, the fuses may be jarred loose from the clips. Still further, a partially opened drawer protruding from the fuseholder may interfere with workspace around the fuseholder. Workers may unintentionally bump into the opened drawers, and perhaps unintentionally close the drawer and re-energize the circuit.

Fusible switching disconnect devices and modules, as described in U.S. application Ser. No. 11/674,880, have been developed that may overcome the aforementioned difficulties. Fusible switching disconnect devices have been developed that may be switched on and off in a convenient and safe manner without interfering with workspace around the device; may reliably switch a circuit on and off in a cost effective manner and may be used with standardized equipment in, for example, industrial control applications; and may be provided with various mounting and connection options for versatility in the field. However, these devices can only be used with a battery powered ICM and therefore are not compliant with the Deutsches Institut für Normung (DIN) 43880 standard that governs the size of devices and accessories.

SUMMARY OF THE INVENTION

The present application relates generally to fuse accessories. More particularly, the present application relates to fuse state indicator modules for fusible disconnect devices.

The present invention provides a fuse state indicator having a housing including a circuit board assembly, a detecting means mounted to the circuit board assembly, at least two conductors electrically connected to the detecting means via the circuit board assembly, and a signal transmitting means. The conductors are adapted for electrical connection to a disconnect device so as to complete a circuit connecting the detecting means with a fuse of the disconnect device. The detecting means detect an open circuit condition, and in some embodiments, the detecting means may be an optical isolator. For instance, when the detecting means includes an optical isolator, the optical isolator is configured to latch when a voltage differential appears across the circuit and transmit a signal to the signal transmitting means for determining an operational state of the fuse. The signal transmitting means, in turn, is configured to transmit a signal to a remote device the state of the fuse. In some embodiments, the signal transmitting means may be an identification element configured to transmit a wireless signal to a remote device for indicating an operational state of the fuse. In other embodiments, the signal transmitting means may be a signal connector configured to transmit an indicating signal to a remote device electrically coupled to the signal connector.

Generally, the fuse state indicator may also include a means of resetting the optical isolator, such as a power switch. In some embodiments, the fuse state indicator further includes an actuator for actuating the means for resetting the optical isolator. In some embodiments, the conductors have forked terminals for connection to a disconnect device having a fuse. In some embodiments, the fuse state indicator further includes a visual indicator, such as a light-emitting diode, electrically connected to the optical isolator via the circuit board assembly, and configured to respond to a latched or unlatched condition of the optical isolator for visually indicating the operational state of the fuse. When an identification element is used, the identification element is configured to transmit a radio frequency signal and may be a transponder, a transmitter, or a responder. In certain embodiments, the identification element may include a processor, a memory, a battery, and/or an antenna. In some embodiments, the fuse state indicator further includes at least one diode connected to the circuitry for protecting the optical isolators from stray signals or voltages.

The features of the present invention will be readily apparent to those skilled in the art upon a reading of the description of the preferred embodiments that follows.

BRIEF DESCRIPTION OF THE DRAWINGS

The present invention may be better understood by reading the following description of non-limitative embodiments with reference to the attached drawings wherein like parts of each of the several figures are identified by the same referenced characters, and which are briefly described as follows.

It is to be noted, however, that the appended drawings illustrate only typical embodiments of this invention and are therefore not to be considered limiting of its scope, as the invention may admit to other equally effective embodiments.

DETAILED DESCRIPTION OF THE INVENTION

The present application relates generally to fuse accessories. More particularly, the present application relates to fuse state indicator modules for fusible disconnect devices.

Figure 1:
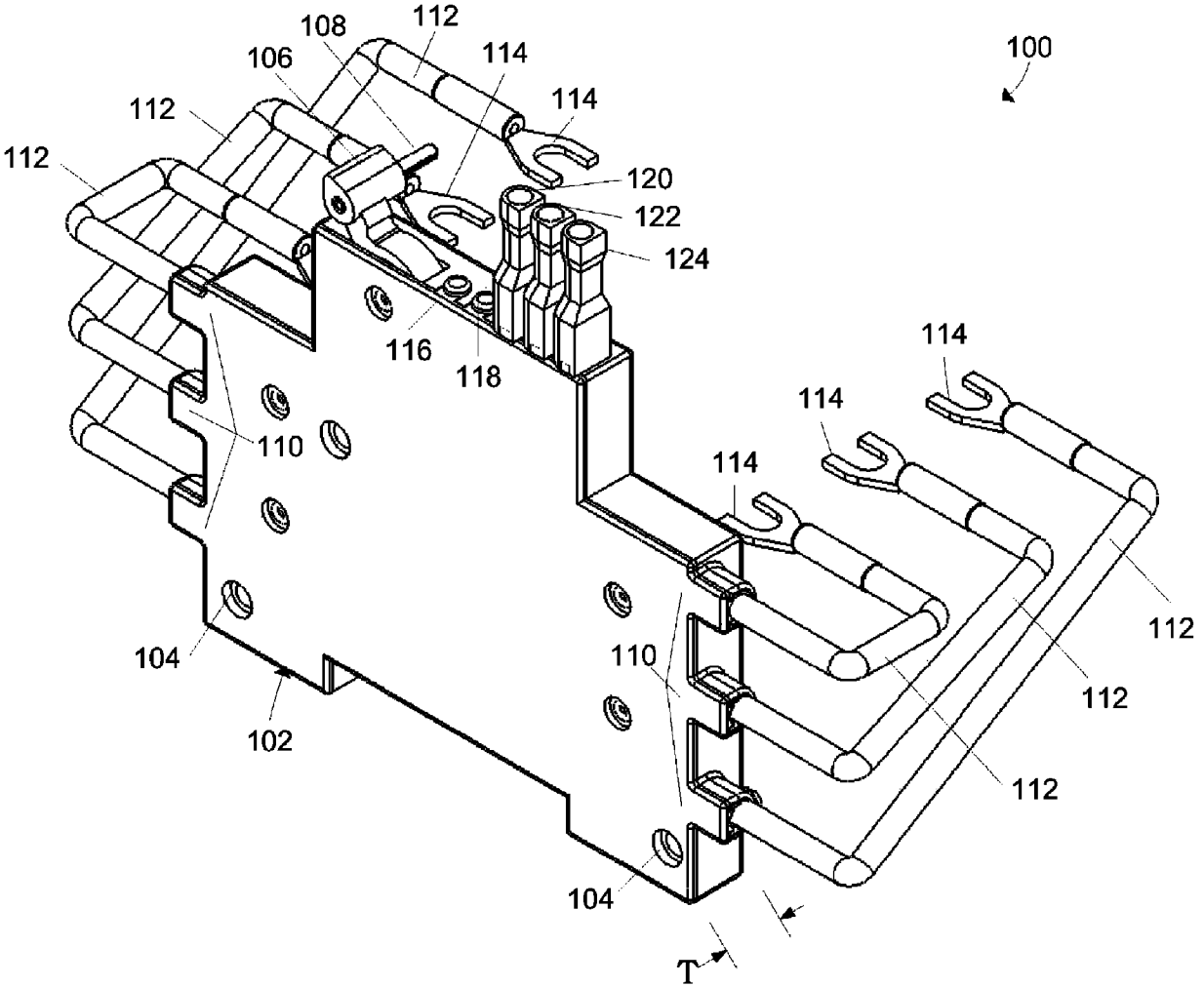
FIG. 1 is a perspective view of a fuse state indicator module for a fusible disconnect device.

FIG. 1 is a perspective view of a fuse state indicator module 100 that may be used in combination, for example, with a fusible disconnect device or module. Suitable examples of fusible disconnect devices or modules include, but are not limited to, those described in U.S. patent application Ser. No. 11/674,880. As such, the fuse state indicator module 100 may be utilized with single or multi-pole disconnect mechanisms, may have various mounting and connection options to protected circuitry, may be used with different types and configurations of fuses, may be used in combination with circuit breakers, modular fuse holders, open style block in new equipment, undervoltage modules, tripping mechanisms, auxiliary contact modules and elements, overload elements, and even other types of monitoring elements.

The fuse state indicator module 100 may include a housing 102 generally complementary in shape to the housing of the fusible disconnect devices and modules used in combination. In some embodiments, the housing 102 has a thickness dimension T of about one half the thickness dimensions of the fusible disconnect devices and modules used in combination. In an exemplary embodiment, the thickness dimension T is about 8.75 mm, but those skilled in the art would recognize that other thickness dimensions, such as, about 17.5 mm are possible. The fuse state indicator module 100 is compliant to the DIN 43880 standard that governs the size of devices and accessories. The housing 102 includes mounting openings or apertures 104 that may receive connectors or shims to gang the housing 102 to a disconnect device or module having complementary mounting openings and apertures.

The housing 102 contains sensing and indication components and circuitry described below to detect opening of fuses in the associated disconnect device and disconnect modules. The fuse state indicator module 100 also includes an actuator 106 that may be tied to the actuator of a disconnect device with a connector pin 108. Signal input ports 110 are provided on either side of the housing 102, and wire leads or conductors 112*a*, 112*b*, and 112*c* internally connect to the sensing components and circuitry in the housing 102 and extend through the signal ports 110 for external connection to terminal elements of a disconnect device or disconnect modules that define the line and load connections to the fuses.

In the illustrated embodiment, each wire lead 112*a*, 112*b* and 112*c* terminates outside the signal ports 110 with fork terminal connectors 114*a*, 114*b* and 114*c*. The terminal connectors 114*a*, 114*b* and 114*c* may be extended into corresponding ports in the disconnect device and any associated disconnect modules, therefore establishing line and load connections to the terminal elements therein. When so connected, the wire leads 112*a* and terminal connectors 114*a* provide electrical connection to a first fuse to be monitored with the fuse state indicator module 100, the wire leads 112*b* and terminal connectors 114*b* provide electrical connection to a second fuse to be monitored with the fuse state indicator module 100, and the wire leads 112*c* and terminal connectors 114*c* provide electrical connection to a third fuse to be monitored by the fuse state indicator module 100. While forked terminal connectors 114*a*, 114*b* and 114*c* are illustrated in FIG. 1, it is recognized that other terminal structures could be provided to connect the wire leads 112*a*, 112*b* and 112*c* to the line and load terminal structures of the fusible disconnect devices and modules.

The three pairs of wire leads 112*a*, 112*b* and 112*c* may be particularly beneficial for a three phase disconnect device supplying AC electrical power to a motor or industrial machine, for example. While three wires 112*a*, 112*b* and 112*c* are illustrated, in an alternative embodiment greater or fewer lead wires 112 may be provided to monitor greater or fewer numbers of fuses. Additionally, to the extent the fuse state indicator module 100 is desired for use with a disconnect device having less than three poles, the unused terminal connectors 114 of the fuse state indicator module 100 may be capped or otherwise covered or disabled.

Light emitting diodes (LEDs) 116 and 118 may be provided and connected to circuitry in the housing 102 and may be visible from an exterior of the housing 102. In an exemplary embodiment, the light-emitting diode (LED) 116 may provide an indication of electrical power supplied to the fuse state indicator module 100, and the LED 118 may provide indication of an opened fuse in the associate disconnect device or module. For example, in one embodiment, the LED 116 may be illuminated to indicate that power to the fuse state indicator module 100 is being received, sometimes referred to as an "on" condition, and is not illuminated when power to the fuse state indicator module 100 is absent, sometimes referred to as an "off" condition. In another embodiment, this indication of "on" or "off" conditions may be effectively reversed such that the LED 116 is lit when power is lost and the LED 116 is not lit when the power is "on". In any event, by virtue of the power LED 116, a user may quickly ascertain whether the fuse state indicator module 100 is receiving electrical power.

Likewise, the fuse indication LED 118, may not be illuminated when the fuses are in an unopened or operative, current carrying state for normal operation, and the LED 118 may be illuminated when at least one of the monitored fuses opens to interrupt or break the current path and the electrical connection through the fuse. In an alternative embodiment, this indication may be reversed such that the LED 118 is lit when the fuses are unopened and is not lit when the fuses are opened. In any event, by virtue of the LED 118, the user may quickly ascertain whether or not any of the fuses have opened and need replacement. Local fuse state indication in the vicinity of the fuse state indicator module 100 is therefore provided by the LED 118.

While visual indicators in the form of LEDs are provided in embodiments described in the present applications so that open fuses may be efficiently located, it is contemplated that other types of visual indicators may alternatively be provided to identify open fuse events with a change in external appearance of the indication module. A variety of visual indicators are known in the art and may alternatively be utilized, including, for example, mechanical indicators having flags or pins that are extended in response to open fuses, electrical indicators having one or more light emitting elements, and indicators exhibiting color changes in response to open fuse events, including but not limited to combustible indicators and indicators having temperature responsive materials and chemically activated color changes.

For remote fuse state indication, output ports and terminal connectors 120, 122 and 124 may be provided in the fuse state indicator module 100. The connectors 120, 122 and 124 provide for connection to a controller, such as a programmable logic controller, that is in turn connected to remote devices and equipment. The connector 120, for example, may correspond to a ground connection. The connector 122 may correspond to a power connection to the fuse state indicator module 100, such as a 24 volts of direct current (V DC) connection to a power supply of the controller. The connector 124 may correspond to a signal connection, such as 0V or 24V DC signal to the controller via a wire indicating the state of the fuse. As the fuse state indicator modules of the present invention may be powered by an external 24V DC, the use of a battery powered Intelligent Circuit Monitor (ICM) may not be necessary. The order in which the connectors 120, 122 and 124 are presented is not important, and may be switched. In one embodiment, the connectors 120, 122 and 124 are known 16 AWG 0.110 quick connect terminal connectors, although it is contemplated that other connectors and terminals could be utilized in an alternative embodiment if desired.

Figure 2:
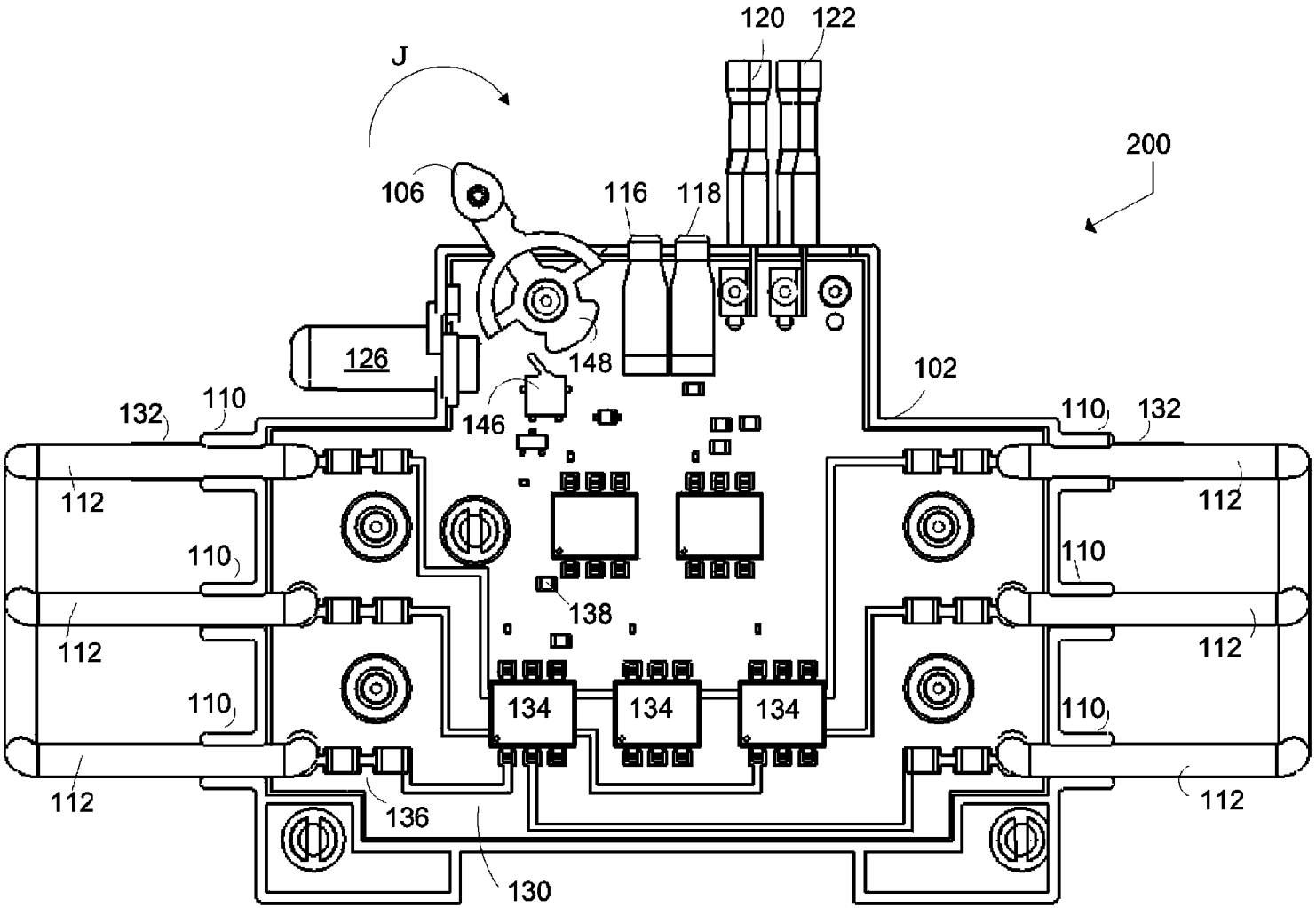
FIG. 2 is a side view of a portion of a wireless fuse state indicator module for a fusible disconnect device, illustrating internal components and construction thereof.

FIG. 2 is a side view of a portion of a fuse state indicator module 200 illustrating its internal components. Fuse state indicator module 200 may be used in combination, for example, with a fusible disconnect device or module. Fuse state indicator module 200 is similar to fuse state indicator module 100, with the exception that fuse state indicator module 200 is wireless. Instead of having a connector 124 corresponding to a signal connection via a wire, fuse state indicator module 200 includes an identification element 126 which communicates, via a wireless connection, with a remote communicating device (not shown) such as a reader or interrogator device. The fuse state indicator modules of the present invention may be considered a lower cost option for providing remote detection of operating states of fuses in fusible disconnect devices and modules. In an exemplary embodiment, the identification element 126 includes an antenna that communicates via radio frequency and the module operates in accordance with known radio frequency identification (RFID) systems. As such, and as those in the art may appreciate, the identification element may be an RFID identification tag and the communicating device may be an RFID reader or an interrogator. Thus, the system operates on close proximity electromagnetic or inductive coupling of the identification element and the communicating device, or alternatively operates using propagating electromagnetic waves. It is contemplated, however, that other forms and types of wireless communication may be utilized in lieu of RFID communication, including but not limited to infrared communication, without departing from the scope and spirit of the invention.

The identification element 126 may be electrically connected to a fuse (not shown) and may be used to determine whether the fuse is in an operational state (i.e., a current carrying or unopened condition completing an electrical connection through the fuse), or whether the fuse is in a non-operational state (i.e., an opened condition breaking the electrical connection through the fuse). In some embodiments, the identification element 126 may be electrically connected in parallel with the primary fuse element and may be located on an outer surface of the fuse state indicator module 200, although it is understood that in an alternative embodiment, the identification element 126 may be interior to the body of the fuse state indicator module 200. In some embodiments, identification element 126 may be constructed of a spiral wound spring antenna and a plastic shield cover.

As shown in FIG. 2, the housing 102 surrounds and protects a circuit board assembly 130, and the lead wires 112 are passed through the signal ports 110. Strain relief features 132 may be molded into the housing 102, for example, to protect the lead wires 112 and their connections to the circuit board assembly 130. Optical isolators 134 are provided to interface the wire leads 112 and 600V AC circuitry of the fuses from the 24V DC circuitry of the circuit board assembly 130 through 300V resistors 136. Each optical isolator 134*a*, 134*b* and 134*c* corresponds to one of the monitored fuses operatively connected between each of the lead wires 112*a*, 112*b* and 112*c*, respectively.

Optical isolators 134 are connected via circuit board assembly 130 to a means for transmitting a signal to a communication device. The optical isolators 134 latch when a voltage differential appears across one of the fuses and sends a signal to the means for transmitting a signal to a communication device. In some embodiments, the means for transmitting a signal may be connector 124 of fuse state indicator module 100 (FIG. 1) that transmits an indicating signal. In some embodiments, the means for transmitting a signal may be identification element 126 of fuse state indicator module 200 (FIG. 2) that transmits a wireless signal. In the instance that a communication device or controller receives the signal at a remote location that an opened fuse event is detected, the communication device or controller may be programmed, for example, to open a contactor or other device to prevent the motor or machine, for example, from running on less than three phases of current. Additionally, the communication device or controller may be programmed to set an alarm condition for prompt action by an operator, provide notification to certain persons of an opened fuse, or execute other instructions provided in the communication device or controller programming as desired. Diodes 138 also may be included in the circuit board assembly 130 to protect input of optical isolators 134 from stray signals or voltages. Optical isolators 134 may also be connected via circuit board assembly 130 to a visual indicator, such as LEDs 116 and 118, for visually indicating the operational state of the fuse. Additionally, a power switch such as a bypass/reset switch 146, or other means of resetting the optical isolators 134, may be provided in the circuit board assembly 130, and is further described below.

While open fuse events are detected with optical isolators, it is understood that other detecting elements and components could be utilized with similar effect, and such detecting elements may monitor and respond to sensed or detected current, voltage, temperature and other operating conditions to detect open fuses. Numerous sensing and detecting elements are known that would be suitable for the indication module as described, including but not limited to current transformers, Rogowski coils, inductors, and the like as those in the art will appreciate.

The printed circuit board assembly 130 also may include the LEDs 116 and 118 and terminals (not shown) for connections to connectors 120 and 122 (and 124, if present). The terminals may be, for example, 0.100 spade terminals known in the art. When bypass/reset switch 146 is provided in the circuit board assembly 130, the switch 146 is actuated by a cam surface 148 of the actuator 106. The switch 146 and cam surface 148 may be constructed so that when the actuator 106 is tied to actuator of the disconnect device or module, movement of the actuator 106 in the direction of arrow J causes the cam surface 148 to operate the switch 146 as the switch contacts in the disconnect device or module are opened. Operation of the switch 146 bypasses signal portions of the circuitry in the fuse state indicator modules of the present invention and also causes the optical isolators 134, and fuse indicating LED 118, to be reset. Bypassing of the signal portions of the circuitry prevents an open fuse signal from occurring when the disconnect device or module is opened. That is, operation of the circuitry is unaffected by the position of the switch contacts in the disconnect device or whether the disconnect device is opened or closed to connect or disconnect the current path through the fuses.

Figure 3:
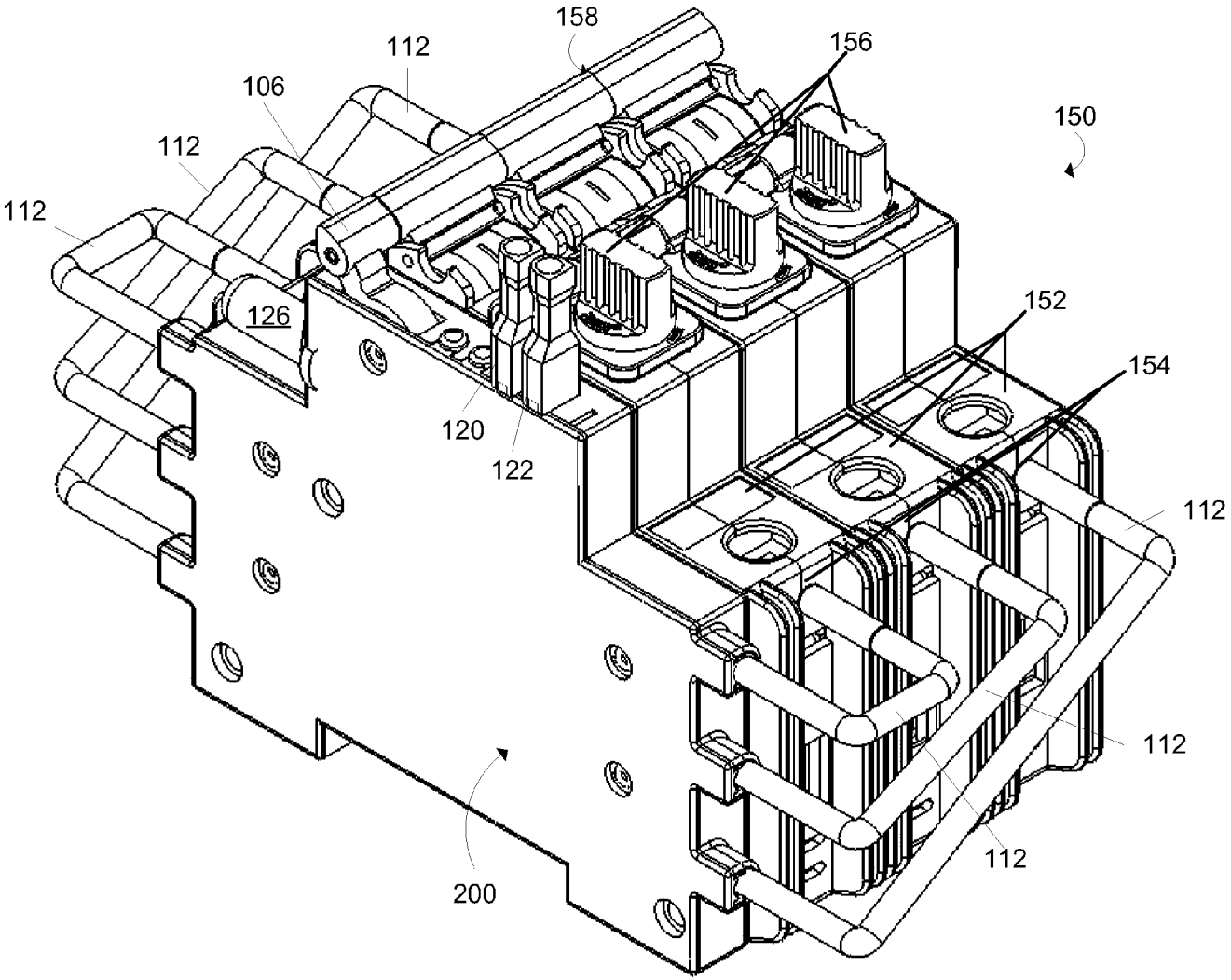
FIG. 3 is a perspective view of the fuse state indicator module shown in FIG. 2 connected to a fusible disconnect device.

FIG. 3 illustrates the fuse state indicator module 200 connected or ganged to a fusible disconnect device 150. The disconnect device 150 may include a number of disconnect modules 152 or may be provided in a single housing as desired. The modules 152 may be a fuse compartment and fuse terminals, or a sliding bar and switch contacts. The modules 152 may further include the addition of access ports 154 for insertion of the terminals 114*a*. 114*b* and 114*c* (FIG. 1) connected to each wire lead 112*a*, 112*b*, and 112*c*. The terminals 114*a*, 114*b* and 114*c* electrically connect to the fuse terminals to place the optical isolators 134*a*, 134*b* and 134*c* across the fuses in each module 152.

Fuse covers 156 are provided on each of the modules 152 of the disconnect device 150, and the covers 156 are positionable to provide access to the fuse compartments for insertion and removal of the fuses. The disconnect device 150 includes an actuator 158 for opening of the switch contacts via the sliding bar as described above, and the actuator 106 of the indicating fuse state indicator modules of the present invention is linked to the actuator 158 of the disconnect device 150. The connectors 122 and 124 are accessible on fuse state indicator module 200 for connection to the controller for power and ground; while connectors 120, 122 and 124 are accessible on fuse state indicator module 100 for connection to the controller for power, ground and signal connections via connecting plugs and wires or cables.

Referring to FIGS. 2 and 3, signal transmission from the identification element 126 to the communicating device (or from a signal connector 124 in FIG. 1 to the communicating device or controller) may reliably indicate the operating state of the fuse on demand. Signal transmission from the identification element 126 to the communicating device is conducted through an air interface and point-to-point wiring is avoided. In some embodiments, the identification element 126 may be a known RFID transponder device which communicates wirelessly with the communication device via an air interface over a predetermined radio frequency carrier, for example, 100-500 kHz, and more particularly, at about 125 kHz. It is understood, however, that other frequency carriers, such as about 904 MHz, may be employed per applicable RFID standards. Also, it is recognized that data transmission rates between the identification element 126 and the communication device are impacted by the selected carrier frequency for signal transmission. That is, the higher the frequency, the higher the transmission rate between the devices.

In some embodiments, the identification element 126 may be a passive radio frequency transmitter, and relies upon a transmission field generated by the communication device for power to respond to the communication device. In such an embodiment, the identification element 126 does not store data relating to the operational state of the fuse. In other embodiments, the identification element 126 may be an active radio frequency transponder, and is powered by an onboard power supply, such as a battery, or alternatively, is powered by the electrical current passing through a secondary fuse link. As such, the identification element 126 is capable of storing data and transmitting the data to the communication device when interrogated. That is, in such an embodiment, the identification element 126 is a read and write device and is capable of advanced functions, such as problem diagnosis and troubleshooting.

The operating range or distance of communication between the identification element 126 and the communication device is dependent upon the power level of the devices, which may be, for example from 100-500 mW, or as dictated by applicable regulations. The range is principally affected by the power available at the communication device to communicate with the identification element 126, the power available within the identification element 126 to respond, and environmental conditions and the presence of structures in the operating environment. In one embodiment the power level of the identification element 126 is much less than the power level of the communication device. It is believed that those of ordinary skill in the art would be able to select appropriate power levels to meet desired specifications and objectives for a particular operating environment without further explanation.

The fuse state indicator modules may therefore be used universally with existing fused systems without retrofitting or modification thereof. Furthermore, the fuse state indicator modules of the present invention may communicate, in addition to the opened or unopened state of the fuse, other information of interest regarding the fused system. In particular, the fuse state indicator modules of the present invention may be used to identify improperly installed or malfunctioning fuses, as well as to provide information pertaining to the electrical system associated with the fuse. The fuse state indicator modules of the present invention are implemented electronically and avoids degradation issues from the passage of time, and may be implemented in a cost effective manner.

Figure 4:
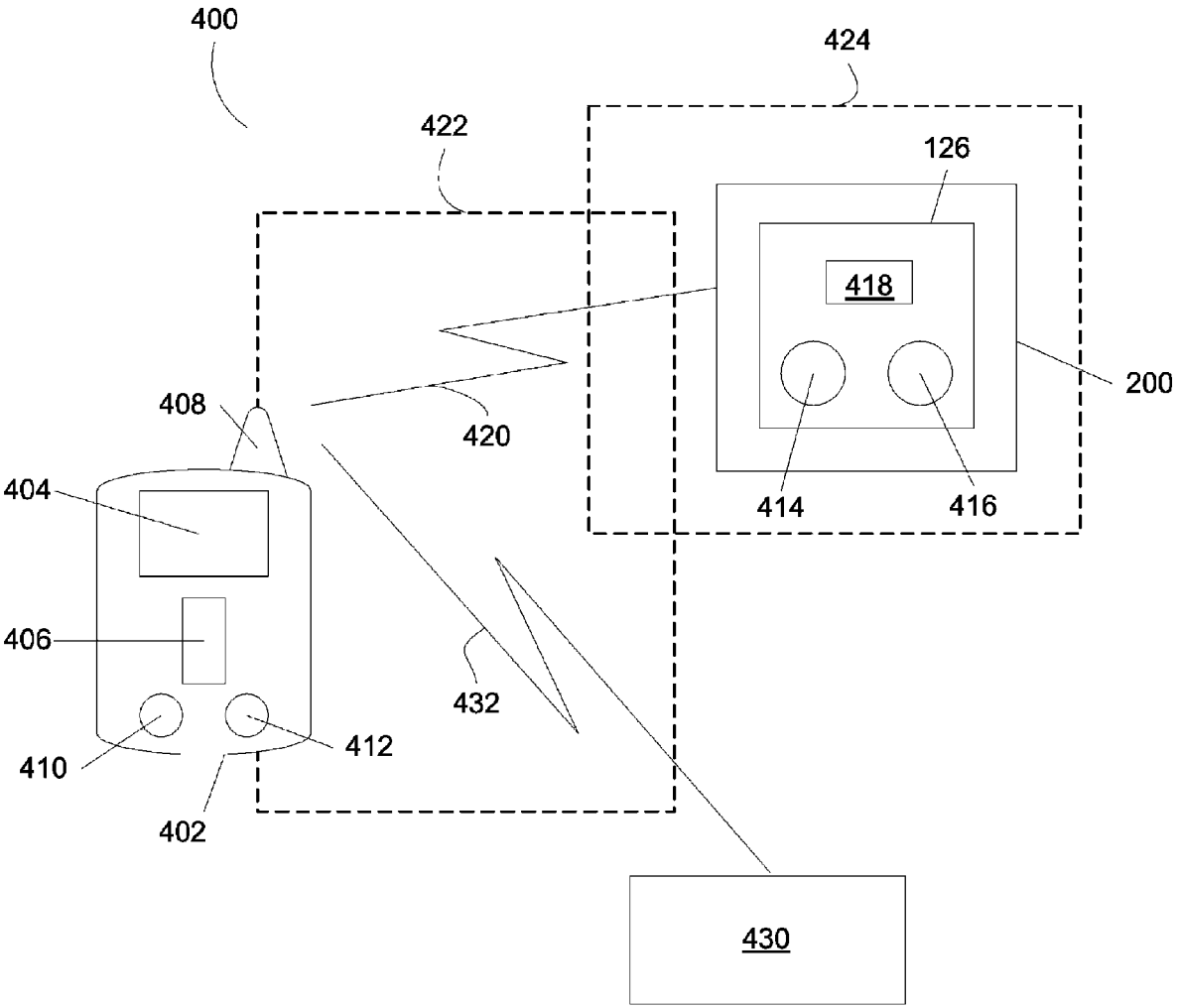
FIG. 4 is a schematic view of a fuse state identification system.

Referring to FIG. 4, in an exemplary embodiment of a system 400, the communication device 402 includes a display 404, an interface 406, an antenna 408, and optionally includes a processor 410 and a memory 412. The identification element 126 of the fuse state indicator module 200 includes a processor 414, an antenna 416, and a memory 418, which in various embodiments may be read-only memory (ROM), random access memory (RAM), or non-volatile programming memory, such as electrically erasable programmable memory (EEPROM), depending on the sophistication of the identification element 126. The processor 414 communicates, via radio frequency by a wireless connection 420, with the communication device 402 when interrogated by the communication device 402, and the antenna 416 senses a field generated by the communication device 402 in operation. The antenna 416 also serves to transmit a response to the communication device 402 in a known manner.

The operational state of a fuse may be determined by a response, or lack of response, from the identification element 126 to an interrogation by the device 402. The communication device 402 may be used to test and diagnose the operational state of a number of fuses without disconnecting the fuses from the associated circuitry. On demand by a user, the communication device 402 interrogates the identification element 126 via wireless communication (e.g., radio frequency communication) over an air interface such that a transmission field 422 of the communication device antenna 408 interacts with a transmission field 424 of the identification element antenna 416. In response to the interrogation, the identification element 126 answers the communication device 402. Depending upon the sophistication of the communication protocol and the relation of the identification element 126 to the primary fuse link of the fuse (not shown), the operational state of the fuse may be determined in a variety of ways by the processor based identification element 126.

The processor based communication device 402 may be programmed to interpret responses to interrogations and provide an output to a user in a readable form. For example, in one embodiment, any signal received from the identification element 126 in response to an interrogation by the communication device 402 may be taken as an indication that the primary fuse element (not shown) is operational. For example, when a primary fuse link opens, the entire fault current would be directed to the identification element 126, and if the identification element 126 is selected so that the fault current destroys or renders the identification element 126 inoperable, the identification element 126 could not function to respond after the fuse has opened. Thus, if no response is received from a given identification element 126, it may be presumed that the associated fuse has opened. Similarly, in another embodiment the identification element 126 could be merely physically located in proximity to a primary fuse element without being electrically connected to its terminal elements or the primary fuse element. In such an embodiment, heat and electrical arcing associated with opening of the primary fuse element would damage the identification element 126 and prevent it from responding to an interrogation. Thus, if no response is received from a given identification element 120, it may be presumed that the associated fuse has opened. As another example, through strategic selection of the identification element 126 and with strategic connection of the identification element 126 to the fuse, the identification element 126 may withstand opening of the primary fuse element and determine the opening of the primary fuse element via, for example, current or voltage sensing of the electrical circuit through the fuse. In such an embodiment, the identification element 126 may respond in a first manner when the fuse is in an operational state and respond a second manner different from the first when the fuse is in a non-operational state. When used in a scanning motion past a number of fuses, the communication device 402 may interrogate the identification elements 126 of the fuses and determine, based upon the type of responses received, which, if any, of the fuses are inoperative.

In a more advanced communications protocol, a response from an identification element 126 may be decoded by the communication device 402, thereby allowing communication of specific data stored in the identification element 126 to be communicated to the communication device 402. For example, one or more of an identification code, a location code, a manufacturing date, etc. and even data pertaining to current characteristics over time may be stored in the memory 418 of the identification element 126. Thus, the system 400 could be of aid in troubleshooting an electrical system. Improperly installed fuses or malfunctioning fuses, may likewise be detected and diagnosed with appropriate programming of the identification element 126 and the communication device 402.

In some embodiments, response information transmitted from the identification elements 126 of the fuses may be displayed directly to a user via the display 404 in a hand held communication device 402, therefore providing real time feedback regarding the state of the fuse or fuses in the vicinity of the communication device 402 which have been interrogated. In some embodiments, the processor 410 of the communication device 402 processes and compiles data and information relating to the state of fuses as interrogations are made and as replies are received, and the data and information is then stored in the memory 412 of the communication device 402. Such data and information stored in the memory 412 may be downloaded to an information management system, or host computer, 430 using a communication link 432, such as, for example, the internet or other network connection, a wireless connection (e.g., radio frequency), an optical communication link, etc. as those in the art will appreciate. The information management system 430 processes and stores the information and data for evaluation by a user for analysis. Any fuses which are opened and require replacement may be identified, together with other data of interest regarding the fused system. Improperly installed fuses or malfunctioning units, may likewise be detected and diagnosed with appropriate programming of the identification element 126 and the communication device 402. Data from the information management system 430 may likewise be transferred from the information management system 430 to the communication device 402, and the data may be used, for example, to match responses from selected identification elements 126 with specific fuses in the system. Additionally, such data may be used to generate interrogatories to specific fuses of a system. In such an embodiment the identification elements 126 of the fuses may be programmed to ignore certain interrogatories and to respond to other interrogatories from the communication device 402. Further, the identification elements 126 of the fuses may be programmed to respond differently as different interrogatories are made. For example, an identification element 126 may send a very basic response to a basic interrogatory, or a detailed response including supporting data for a more advanced interrogation.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Having described some exemplary embodiments of the present invention, it is believed that the programming of the system components to achieve desired outputs for monitoring the status of the fuses and the associated fuse system is within the purview of those in the art. While numerous changes may be made by those skilled in the art, such changes are encompassed within the spirit of this invention as defined by the appended claims. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. The terms in the claims have their plain, ordinary meaning unless otherwise explicitly and clearly defined by the patentee.

What is claimed is:

1. A fuse state indicator comprising:

a housing containing a circuit board assembly;

an optical isolator mounted to the circuit board assembly;

at least two conductors electrically connected to the optical isolator via the circuit board assembly, said conductors extending from the housing and comprising connectors for electrically connecting to a disconnect device, so as to complete a circuit connecting the optical isolator with a fuse of the disconnect device;

wherein said optical isolator is configured to latch when a voltage differential appears across said circuit and to generate a signal in response thereto; and a signal connector configured to receive said signal from the optical isolator and to transmit an indicating signal to a remote device when said remote device is electrically coupled to the signal connector, said indicating signal for indicating an operational state of the fuse.

2. The fuse state indicator of claim 1, further comprising a means for resetting the optical isolator.

3. The fuse state indicator of claim 2, further comprising an actuator for actuating said means for resetting the optical isolator.

4. The fuse state indicator of claim 1, wherein the connectors comprise forked terminals.

5. The fuse state indicator of claim 1, further comprising a visual indicator electrically connected to optical isolator via said circuit board assembly, said visual indicator configured to respond to a latched or unlatched condition of said optical isolator for visually indicating the operational state of the fuse.

6. The fuse state indicator of claim 1, further comprising at least one diode connected to the circuit board assembly for protecting the optical isolator from stray voltages.

7. A fuse state indicator comprising:

a housing containing a circuit board assembly configured to detect an open circuit condition;

at least two conductors electrically connected to the circuit board assembly, said conductors extending from the housing and comprising connectors for connecting the circuit board assembly with at least one fuse at a location exterior to the housing and to complete a circuit path through the circuit board assembly;

wherein said circuit board assembly is configured to detect an opening of said at least one fuse and wherein the circuit board assembly includes at least one optical isolator configured to latch when a voltage differential appears across a circuit path including the at least one fuse and to generate a signal in response thereto; and a signal transmitting means associated with the circuit board assembly and configured to transmit a signal, in response to a detected opening of the fuse, to a remote device for indicating an operational state of the at least one fuse.

8. The fuse state indicator of claim 7, wherein the connectors comprise forked terminals.

9. The fuse state indicator of claim 7, wherein the circuit board assembly includes a visual indicator configured to respond to a detected opening of the fuse.

10. The fuse state indicator of claim 7, wherein the signal transmitting means is a signal connector configured to be electrically coupled to the remote device.

11. The fuse state indicator of claim 7, wherein the at least one fuse comprises a plurality of fuses, and wherein the circuit board assembly is configured to simultaneously monitor a plurality of circuit paths each respectively associated with the plurality of fuses.

12. The fuse state indicator of claim 11, wherein the circuit board assembly is further configured to generate a signal in response to operation of any of the fuses to open one or more of the plurality of circuit paths.

13. The fuse state indicator of claim 12, wherein the signal transmitting means is a signal connector configured to be electrically coupled to the remote device.

14. The fuse state indicator of claim 11, wherein the at least two conductors electrically connected to the circuit board assembly comprises a plurality of pairs of conductors electrically connected to the circuit board assembly, each pair of conductors establishing an electrical connection with one of the plurality of circuit paths.

15. The fuse state indicator of claim 7, wherein the at least one fuse comprises a plurality of fuses each associated with a respective one of a plurality of circuit paths, and wherein the circuit board assembly includes a plurality of optical isolators respectively associated with each of the plurality of circuit paths, wherein each optical isolator is respectively configured to latch when a voltage differential appears across a respective one of the plurality of circuit paths and to generate a signal in response thereto.

16. The fuse state indicator of claim 15, wherein the signal transmitting means comprises a single signal connector configured to be electrically coupled to the remote device.

17. The fuse state indicator of claim 7, wherein the at least one fuse completes a current path in a disconnect device provided separately from said housing.

18. The fuse state indicator of claim 17, wherein the at least one fuse comprises a plurality of fuses, wherein said circuit board assembly is configured to generate a signal in response to a detected opening of any of said plurality of fuses, and wherein said signal transmitting means is configured to transmit a signal to a remote device for indicating an operational state of the fuse when any of the plurality of fuses has opened.

19. The fuse state indicator of claim 18, wherein the signal transmitting means comprises at least one signal connector configured to be electrically coupled to the remote device.

20. The fuse state indicator of claim 18, wherein the signal transmitting means is a single signal connector.

21. A fuse state indicator system comprising:

a modular fusible switching disconnect device assembly comprising at least one disconnect housing and a plurality of circuit paths, wherein each of the plurality of circuit paths is completed by an overcurrent protection fuse and includes a switchable contact, each of the circuit paths further including line side and load side terminals with the overcurrent protecting fuse and the switchable contact completing a current path therebetween; and a modular indicating assembly attachable to the disconnect device assembly, the modular indicating assembly comprising:

an indicator housing separately provided from the disconnect housing and containing a circuit board assembly;

detecting means for detecting an open circuit condition in any of the respective circuit paths when one or more of the overcurrent protection fuses operate to open the respective circuit path, said detecting means mounted to the circuit board assembly;

a plurality of pairs of conductors electrically connected to the detecting means via the circuit board assembly, each respective one of the plurality of pairs of conductors extending from the housing for electrical connection to a respective one of the current paths in the disconnect device assembly so as to complete a circuit connecting the detecting means in parallel with each of the fuses in the respective circuit paths;

wherein said detecting means is configured to simultaneously monitor and generate a signal in response to operation of any of the fuses in the disconnect assembly to open one or more of the circuit paths; and a signal transmitting means configured to receive said signal from the detecting means and to transmit a signal to a remote device for indicating an operational state of the fuses in the disconnect device.

22. The fuse state indicator system of claim 21, wherein the signal transmitting means is a signal connector configured to be electrically coupled to the remote device.

23. The fuse state indicator of claim 22, wherein the signal transmitting means is wired to the remote device.

24. The fuse state indicator of claim 22, wherein the signal transmitting means communicates with the remote device via one of a wired or wireless means.

25. A fuse accessory comprising:

a housing containing a circuit board assembly;

at least one optical isolator mounted to the circuit board assembly;

at least a first pair of conductors electrically connected to the at least one optical isolator via the circuit board assembly, said first pair of conductors extending from the housing for establishing an electrical connection to a fused current path at a location external to the housing and to complete a circuit path through the at least one optical isolator;

wherein the at least one optical isolator is configured to latch when a voltage differential appears across the fused circuit path, thereby providing a signal in response thereto; and a signal transmitting means configured to receive the signal from the at least one optical isolator and to transmit an indicating signal to a remote device when said remote device is electrically coupled to the signal transmitting means, said indicating signal for indicating an operational state of the fused current path.

26. The fuse accessory of claim 25, wherein the fused current path is defined in a disconnect device provided separately from the accessory.

27. The fuse accessory of claim 25, wherein the signal transmitting means is one of a wireless device and a signal connector hard wired to the remote device.

28. The fuse accessory of claim 25, wherein the at least one optical isolator comprises a plurality of optical isolators, and the at least a first pair of conductors comprises a plurality of pairs of conductors each respectively extending from the housing for connection to one of a plurality of fused current paths at a location external to the housing and to complete a circuit path through a respective one of the plurality of optical isolators.

29. The fuse accessory of claim 28, wherein the plurality of fused current paths are defined in a disconnect device provided separately from the accessory.

30. The fuse accessory of claim 28, wherein the signal transmitting means is configured to receive a signal from any one of the plurality of optical isolators and to transmit an indicating signal to the remote device for indicating an operational state of any one of the plurality of the fused current paths.

31. The fuse accessory of claim 25, further comprising connectors coupled to distal ends of the first pair of conductors.

32. The fuse accessory of claim 31, wherein the connectors comprise fork terminal connectors.

* * * * *